United States Patent [19]

Hays et al.

[11] 3,967,590

[45] July 6, 1976

[54] HEAT EXCHANGE CONTROL SYSTEM

[75] Inventors: Herbert G. Hays, Amana; Richard D. Maxwell, Cedar Rapids, both of Iowa

[73] Assignee: Amana Refrigeration, Inc., Amana, Iowa

[22] Filed: Aug. 29, 1975

[21] Appl. No.: 608,951

Related U.S. Application Data

[63] Continuation of Ser. No. 436,231, Jan. 24, 1974, abandoned.

[52] U.S. Cl. ..... 122/4 R; 219/279; 431/62

[51] Int. Cl.[2] ..... F22B 21/06

[58] Field of Search ..... 126/110 R, 110 B, 116 R, 126/116 C; 431/62, 63, 354, 258, 259; 122/4 R, 41 R; 219/279; 236/15 E

[56] References Cited

UNITED STATES PATENTS

| | | | |
|---|---|---|---|
| 1,431,633 | 10/1922 | Clements | 431/354 |
| 2,707,989 | 5/1955 | Schori | 431/259 |
| 3,302,705 | 2/1967 | Witten, Jr. | 122/367 C |
| 3,704,748 | 12/1972 | Hapgood | 165/165 |
| 3,861,855 | 1/1975 | Seider | 236/15 E |

*Primary Examiner*—William E. Wayner
*Assistant Examiner*—William E. Tapolcai
*Attorney, Agent, or Firm*—Milton D. Bartlett; Joseph D. Pannone; David M. Warren

[57] ABSTRACT

A package heat exchange system having a burner positioned in the central plenum of a first heat exchanger and supplied with a fuel-air mixture through a blower supplied with fuel through a pressure regulator which requires a negative pressure at the blower input to draw gaseous fuel through the pressure regulator. Thermal energy is transferred from the first heat exchanger to a second heat exchanger or from the second heat exchanger to a third heat exchanger by pumped fluids and transferred to or from the second heat exchanger and air blown through the second heat exchanger to heat or cool the air with blowing of the air, operation of the burner and heating of the first heat exchanger when the burner is not operating being used to maintain the temperature of the surface of the first heat exchanger which contacts the products of combustion of the burner above the dew point of the products of combustion.

7 Claims, 10 Drawing Figures

HEAT EXCHANGE CONTROL SYSTEM

This is a continuation of application Ser. No. 436,231, filed Jan. 24, 1974, now abandoned.

BACKGROUND OF THE INVENTION

Compact heat exchange systems using, for example, a burner positioned inside a plenum formed by a heat exchanger which has a surface area contacting the products of combustion which is substantially larger than the surface area contacting a fluid to be heated by the products of combustion can economically extract heat from the products of combustion so efficiently that condensation from flue gas products occurs in the heat exchanger and causes deposits to be formed either by interaction with the heat exchanger surface coating or by deposition of particulate matter from the products of combustion. Such deposits can result in partial plugging of the passages of the heat exchanger through which the products of combustion pass which, in turn, further reduces the heat supplied to the heat exchanger in these regions thereby increasing the amount of condensation.

Formation of such deposits may be particularly severe when excess air is supplied to the burner to reduce the emission of pollutants from the products of combustion since this reduces the temperature of the products of combustion passing through the heat exchange passages.

In addition, the temperature at the surface of some parts of the burner heat exchanger may produce condensation deposits if the fluid being heated enters the heat exchanger at too low a temperature and at too high a rate thereby overcooling the burner heat exchanger.

In addition, a heating system may be combined with a cooling system in a package unit, for example, for external mounting in the back yard or on the roof of a home, and full advantage may then be taken of a common blower for blowing air through the home from the package unit, with said air being either heated by an air heater or cooled by an evaporating heat exchanger. Previous to this invention, hot air heaters have been used in such package units so that the cooled air was blown through the hot air heat exchanger during periods when no heat is being supplied to the heater and, as a result, air at or near the dew point of the air, or contaminants thereof, formed deposits by reaction or otherwise on the surface of the hot air heater which upon being heated caused accelerated corrosion thereof. Therefore, the life of such a hot air heater was reduced, particularly if the hot air heater was designed to operate near the upper limit of its safe operating range to achieve a sufficiently compact size to fit in an economically feasible heating and cooling unit.

In addition, while materials and coatings for the cooling heat exchanger may be properly chosen and designed for long life since this heat exchanger may be placed on the input side of the blower and, hence, never subject to overheating, a hot air heater cannot normally be economically coated with a material which will protect against dew point corrosion and will also stand elevated temperatures without substantial expense and difficulty.

Furthermore, derating such a hot air heater to a point where adequate life is obtained makes such units bulky and heavy and renders such units overly expensive.

SUMMARY OF THE INVENTION

In accordance with this invention, a heat exchange system is provided in which the heat exchanger is maintained substantially above the dew point of the products of combustion at all times whereby corrosion and change in performance of the unit are minimized.

More specifically, a heat exchanger is provided having a substantially larger surface area in heat exchange relationship with the products of combustion supplied thereto than the surface area of the fluid being heated, and an auxiliary heater is provided for the heat exchanger to maintain the heat exchanger above the dew point during periods when the products of combustion are not being supplied to the heat exchanger. Because the heat exchanger has a large ratio of flue gas area to circulating fluid area, the total volume of the heat exchanger and fluid therein is relatively small and can be maintained at the desired temperature level with a very small auxiliary electric heater.

In addition, in accordance with this invention, the control system provides for continuing the burner blower for a predetermined period of time after fuel has been cut off from the burner to thoroughly purge the burner area of flue gases but not for a sufficient period of time to reduce the temperature of the heat exchanger below the effective dew point temperature.

Further in accordance with this invention, there is provided a control circuit for a high performance heat exchanger having an extended surface contacting the products of combustion produced by a burner for transferring heat to a fluid wherein the firing rate of the burner upon starting is reduced to a rate below the maximum firing rate for a predetermined time which allows the circulating fluid in the heat exchanger to absorb the heat produced by that firing rate even when being circulated with a pump at a lower than normal rate due to the increased viscosity of the fluid, for example, at subzero temperatures whereby localized overheating of the heat exchanger is prevented.

More specifically, the heater comprises a plurality of tubular elements surrounding a central plenum interconnected by conductive elements to form a rigid heat exchanger. A burner supplies heat to the plenum and is preferably positioned within the plenum. The burner preferably comprises a rigid apertured cylindrical structure which directs an air-fuel mixture outwardly through the apertures toward the heat exchanger, with combustion occurring between the burner and the heat exchanger. Preferably, the velocity of the fuel-air mixture through the apertures is sufficient to result in the flame front extending across the regions between the jets and being separated from the apertured wall of the burner thereby maintaining the burner wall at a temperature substantially below the combustion temperature so that non-refractory materials may be used for the burner.

In order to provide a reliable multiple firing rate control system for the burner using standard commercially available electrical components, this invention provides for a constant speed motor such as a conventional split-phase induction motor which drives a blower whose output feeds the burner and whose input is supplied fuel in the form of a gas through one port and air through a second port. The size of said ports is preferably selected for the optimum combustion ratio for the maximum desired firing rate of the burner. The gas port is supplied preferably via a zero pressure regulator and a solenoid controlled valve so that gas is sucked into the blower as a function of blower speed when the solenoid valve is energized. However, if the blower is stopped, no gas is supplied by the zero pressure regulator since a negative pressure is not produced in the output of the pressure regulator because the blower suction is lacking. In addition, the control circuit preferably provides for shutting the solenoid controlled fuel valve prior to deenergization of the blower to thoroughly purge the burner heat exchange region of combustion products upon each shutdown of the burner.

This invention further provides for an auxiliary electric heater for heating the flue gas exchanger whereby said heat exchanger is maintained at all times above the effective dew point of the external atmosphere to avoid undue corrosion of the heat exchanger.

Further in accordance with this invention, the firing rates of the burner are sufficiently great that the exhaust temperature from the heat exchanger is above the condensation point of the combustion products so that corrosion of the output portions of the heat exchanger and the exhaust flue are reduced. Also, excess air is preferably provided which reduces the peak combustion temperature of the burner thereby reducing the production of undesirable pollutants, such as oxides of nitrogen, while still extracting more heat energy from the fuel than is extracted with conventional home heaters.

This invention further provides a movable apertured plate to effectively maintain the optimum air-fuel ratio at a reduced firing rate, which is still sufficient to cause the flame front to be separated from the apertured burner wall. The apertured plate is positioned in the plenum at the blower input, and is moved to separately reduce the effective port size of the air intake port and the gaseous fuel intake port, said plate being automatically removed and applied to said intake ports to produce the desired change in firing rate. By such a separate control of separate ports of the fuel and air, accurate control of firing rates and fuel-air mixtures for each of said rates is obtained.

Further in accordance with this invention, a safety control circuit is preferably used comprising a fusible wire surrounding the heater under tension and positioned in the main power circuit of the system. As a result, in the event that localized overheating of the boiler occurs due to unforeseen failure of other control circuit components in addition to failure, for example, of the circulating pump or loss of circulating fluid, the fusible element will melt and separate thereby shutting down the system prior to damage of other components of the package unit, such as air conditioning units, which might otherwise occur. More specifically, the fusible element preferably consists of a length of fusible wire positioned in a refractory insulating sheet, such as a fiberglass tube, and passing in two locuses around the outside of the flue plenum surrounding the heat exchanger. By maintaining a tension on the fusible element, for example by a spring loading, any burn-through of the flue will cause overheating of the fusible element and shutting down of the power supply to the burner thereby providing an absolute fail-safe control circuit in addition to the normal circulatory control sensor and control circuits.

This invention further provides a combined heating and cooling system wherein a flue gas heat exchanger positioned at a first location supplies thermal energy to fluid circulated through said flue gas heat exchanger and through an air heat exchange means positioned in a region spaced from said flue gas heat exchanger with air blown through said air heat exchange means to heat or cool a region such as a home or other living space. The air heat exchange means also provides for cooling the air by being the evaporator of a thermal pumping system, and such air heat exchange means may be made of a suitable material and/or properly surface coated so that condensation of water vapor or contaminants from cooking odors or sprays from the home will not produce corrosion or other deleterious effects on the heat exchange means. The thermal pump may be positioned adjacent the flue gas heat exchanger, and a refrigerant condenser heat exchanger for the thermal pump may be positioned adjacent the thermal pump and flue gas heater so that during operation a fan may draw air over the thermal pump and the flue gas heat exchanger to cool the condenser and condense the refrigerant. During cooling mode operation this invention provides for maintaining the small compact volume of an extended surface flue gas heat exchanger, such as a plurality of tubes interconnected by solid members surrounding a central plenum containing a burner, at a temperature above the effective dew point of flue gas in the heat exchanger or, for example, above 80° Fahrenheit and preferably above 100° Fahrenheit.

More specifically, because the fluid heated by the flue gas heat exchanger is not circulating during periods when the burner is not supplying heat to the fluid, a very small volume of heat exchange material and fluid must be kept warm, and this may be accomplished by a very small heater, such as a 25-watt heater, attached to the lower end of the flue gas heat exchanger, for example around the lower fluid plenum thereof. As a result, a package heater and cooler may be produced in which the heater portion may be operated at peak efficiency during the heater mode of operation and will not be deleteriously affected during the cooling operation. Furthermore, the heat extracted from the air heater heat exchanger by the blower blowing air therethrough into the home will be substantially independent of differing air blower loads due, for example, to various portions of the home having air duct dampers opened and closed since this may be adjusted by selection of the circulation rate of the fluid between the flue gas heat exchanger and the air heat exchanger for a given firing rate. Also, this invention provides that during start-up when the burner firing rate may be operated in reduced firing rate mode, the air blower for circulating air through the air heat exchanger may be also reduced in speed to maintain the proper rate of extraction of thermal energy from the flue gas heat exchanger without reducing said heat exchanger flue gas surface temperature to a point where condensation might occur on portions thereof, particularly when the outside temperature is very low, for example below freezing, and/or the air intake to the burner is quite humid.

BRIEF DESCRIPTION OF THE DRAWINGS

Other and further objects of this invention will be apparent as the description thereof progresses, reference being had to the accompanying drawings wherein.

DESCRIPTION OF THE PREFERRED EMBODIMENT

Referring now to FIGS. 1 through 6, there is shown a package unit 10 having a base on which are supported side walls and a top which may be made of sheet metal removably attached to an angle iron frame as in conventional package heating units.

Positioned adjacent one side of the package 10 approximately midway between the ends thereof is a compact heater unit 11 preferably of the type disclosed in greater detail in the aforementioned application.

Figure 3:
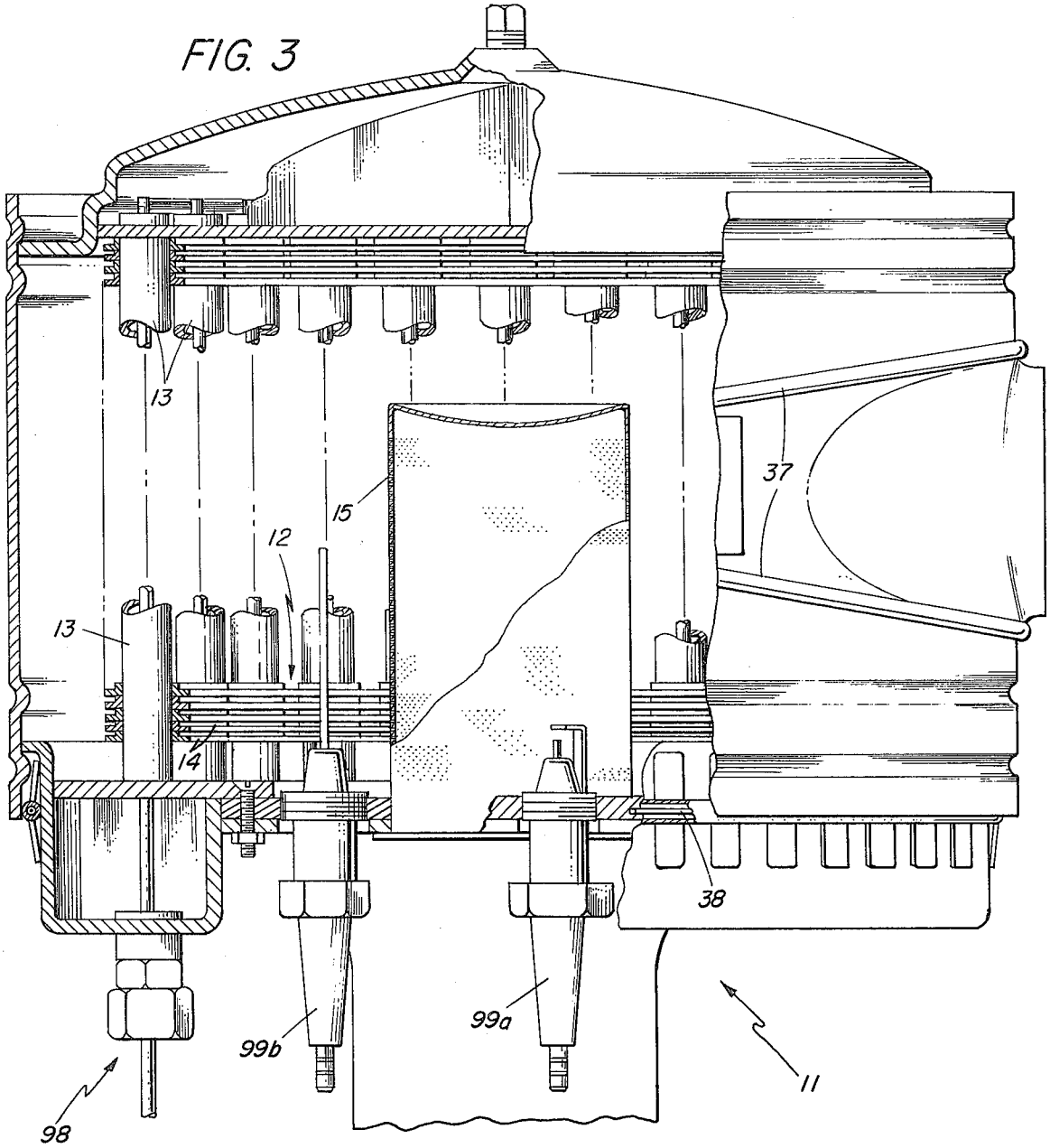
FIG. 3 illustrates a longitudinal sectional view of the heat exchanger of the heater unit illustrated in FIGS. 1 and 2.
Figure 4:
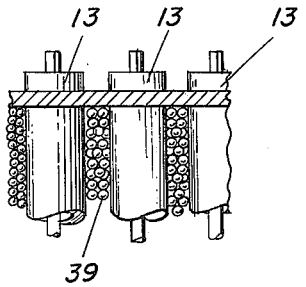
FIG. 4 illustrates a fragmentary sectional view of an alternate embodiment of the heat exchanger illustrated in FIG. 3.
Figure 6:
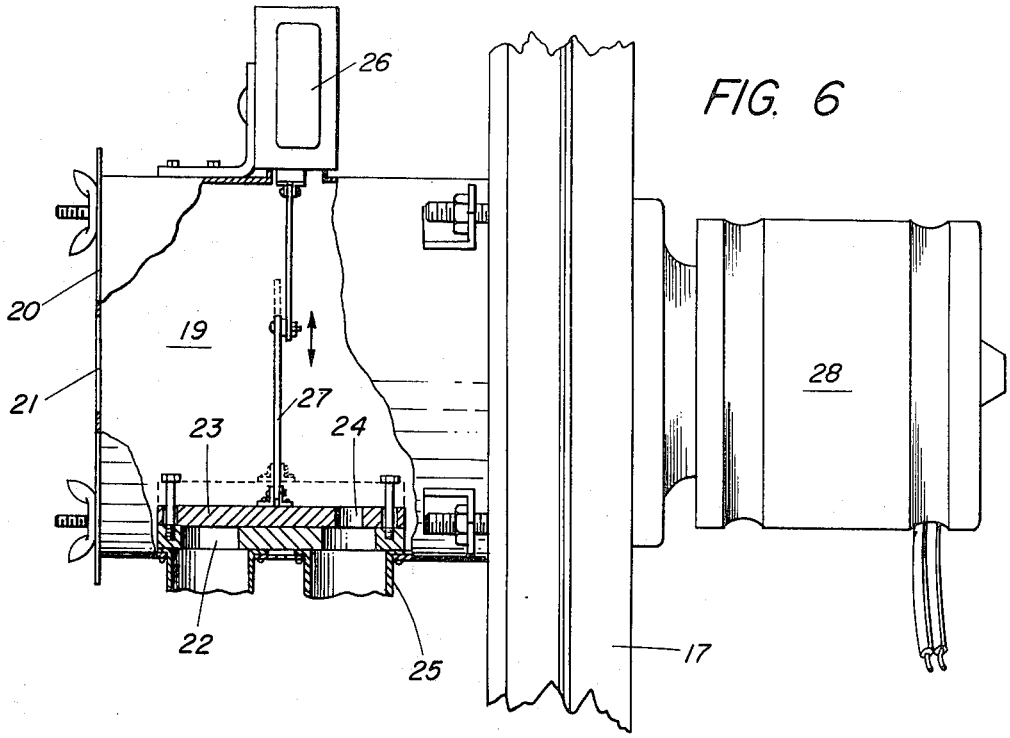
FIG. 6 illustrates details of a multiple firing rate fuel and air port size control structure for use with the system illustrated in FIGS. 1 through 6.

As illustrated in greater detail in FIGS. 3 and 4, heater 11 consists of a cylindrical matrix 12 comprising a plurality of tubes 13 through which is circulated a liquid to be heated. Tubes 13 are interconnected by a plurality of fins 14 interconnecting tubes 13 and bonded to tubes 13 to form the unitary thermally stable matrix 12 surrounding a central plenum. Flue gas produced by the products of combustion from a burner 15 centrally located in the matrix plenum is forced outwardly through the spaces between the fins 14 along heat exchange paths having an average length through the matrix preferably less than four times the average radius of curvature of the tubes 13. Under these conditions large quantities of heat may be transferred from the burner 15 to the matrix. The liquid flowing through the tubes 13 extracts heat from the matrix to maintain all regions of the matrix below temperatures which would damage the matrix, for example, by melting the bonds between the fins and the tubes. More specifically, if said bonds are formed by brazing steel tubes and fins with copper, all regions of the matrix brazing joints should be maintained below 1000°F.

Fuel is supplied to the heater 11 through a solenoid controlled valve and pressure regulator 16 whose output is gas at a pressure slightly below atmospheric pressure. The output of regulator 16 is fed to the input of a blower 17 driven by a blower motor 18 so that blower 17 supplies a fuel-air mixture to the burner 15 of the heater 11.

Theinputofthe blower 17 comprises an input plenum 19 having a cover plate 20 with an aperture 21 therein. The low side of plenum 19 has a second aperture 22 covered by a plate 23 during low fire condition of burner 15 so that air through aperture 21 is supplied to the burner. Fuel is supplied to the burner through an aperture 24 in plate 23 which also covers the end of a fuel pipe 25 connected to the output of fuel regulator 16 to restrict the flow of fuel during low fire condition. Plate 23 may be lifted for high fire condition of burner 15 by energization of a solenoid 26 which actuates a linkage mechanism 27 connected to plate 23 to lift plate 23 thereby uncovering the additional air aperture 22 and the larger aperture beneath fuel aperture 24 to allow more fuel and air to enter the blower 17. Selection of the size of the apertures 21, 22 and 24 permits accurate selection of the fuel-air mixture for either of the two firing rates.

Liquid heated by the heater 11 is circulated through a pipe 28 to a heat exchanger 29 at one end of the package 10 and thence through a return pipe 30 to a return pipe 31 which forces the fluid back through the tubes 13 in the heater 11. As illustrated herein, the fluid makes six passes through the heat exchanger matrix 12 by reason of the upper and lower ends of tubes 13 communicating with upper and lower plenums having baffles which feed the input from pump 31 to the lower ends of a first group of four of the tubes 13, and the upper ends of said first group to the upper ends of a second group of said tubes 13 whose lower ends feed a third group and so on through six groups of tubes 13, with the last group feeding the heat exchanger 29 through pipe 28.

The upper end of heat exchanger coil 29 is also connected to an expansion tank 33 having a vent pipe which is closed by a rubber grommet 34 having a slit 35 therein to maintain the system substantially at atmospheric pressure while preventing any substantial loss by vaporization of the liquid. The liquid may be, for example, pure water, or in the event the unit is to be mounted outside the area to be heated, a mixture of water and antifreeze such as ethylene glycol.

Tank 33 is positioned in a region of the package without substantial heat insulation so that any vapors of the liquid which are generated in the system will condense in the tank 33.

A dual blower 42, driven by a blower motor 47 mounted between the dual blower 42, is positioned in a space separated from the heater 11 by a wall 36 and blows air from said space through the heat exchanger 29. The input of blower 42 draws air from a cold air return duct 40 which is connected to the system 10 adjacent heat exchanger 29. A duct 46 is connected to the outlet at the end of the package 10 above the duct 40 and conducts air which has been blown through heat exchanger 29 back into the home to heat the home.

The walls of the compartment containing the blower 42 may be insulated with insulating material to prevent heat transfer of the air to the outside region of the system 10 and to absorb noise from the blower 42. As illustrated herein, wall 36 separates the region containing the expansion tank 33 from the region into which blower 42 exhausts so that tank 33 may be maintained cooler than the output region from the blower 42, hence aiding in condensing any vapors produced in the heater system and entering the tank 33.

To provide for cooling the air blown into duct 46 by blower 42, for air conditioning, a cooling compressor 60 is provided on the opposite side of the cabinet from the heater 11. The compressor is of a conventional air conditioning type which compresses a refrigerant working fluid such as Freon and supplies it to a condenser 62 of conventional type consisting of tubes and fins. Condenser 62 is positioned on the opposite end of the system 10 from the heating coil 29 and thus is exposed to the open air.

Liquid Freon from condenser coil 62 is piped via a conventional expansion valve to a Freon expansion coil 64 which covers the end of the intake duct 40 and cools the air to blower 42 when the compressor 60 is operating. The Freon from coil 64 is then returned to compressor 60 by a return pipe. Additional components such as filter-driers are also preferably incorporated in the system in accordance with well-known practice.

The condenser coil 62 has air blown over it from inside the unit 10 by means of a fan 65 driven by a motor 66. As illustrated herein, the fan 65 is mounted in a surrounding shroud 67 to improve fan efficiency.

Vents on the sides of the package 10 in the region occupied by the heater 11 and the compressor 60 provide an air intake for burner blower 17 and/or air for fan 65 which also maintains compressor 60 in a condition where operation will not overheat it.

Referring now to FIG. 4, there is shown a fragmentary detailed view of an alternate form of the heater unit illustrated in FIG. 3 wherein the tubes 13 are the same as those shown in FIG. 3 but fins 14 have been replaced by a plurality of spheres 39 bonded together and to the tubes 13 filling the spaces between the tubes 13. Preferably, the flue gas from burner 15 passes through at least three layers of balls 39. However, if desired, more layers can be used to extract more heat, dependent upon the amount of heat produced by the burner 15. For example, with a unit shown in FIG. 3 having a total surface area of the interior of the tubes 13 on the order of one square foot, several hundred thousand BTU's of energy produced by the burner 15 may be transferred to the fluid in tubes 13. For operation in the system disclosed, the burner 15 may be, for example, fired at 120,000 BTU's and in excess of 80% of the input heat will be absorbed in the fluid. The flue gas will also have a temperature above the dew point.

For the purposes of this invention, the term "dew point" is defined as the flue gas temperature below which substantial condensation from the flue gas occurs on the heat exchanger. The dew point temperature is a function of the total water vapor in the flue gas and the temperature of the coldest portion of the heat exchanger contacted by the flue gas, which is also, among other things, a function of the temperature of the fluid passing through the heat exchanger.

Figure 1:
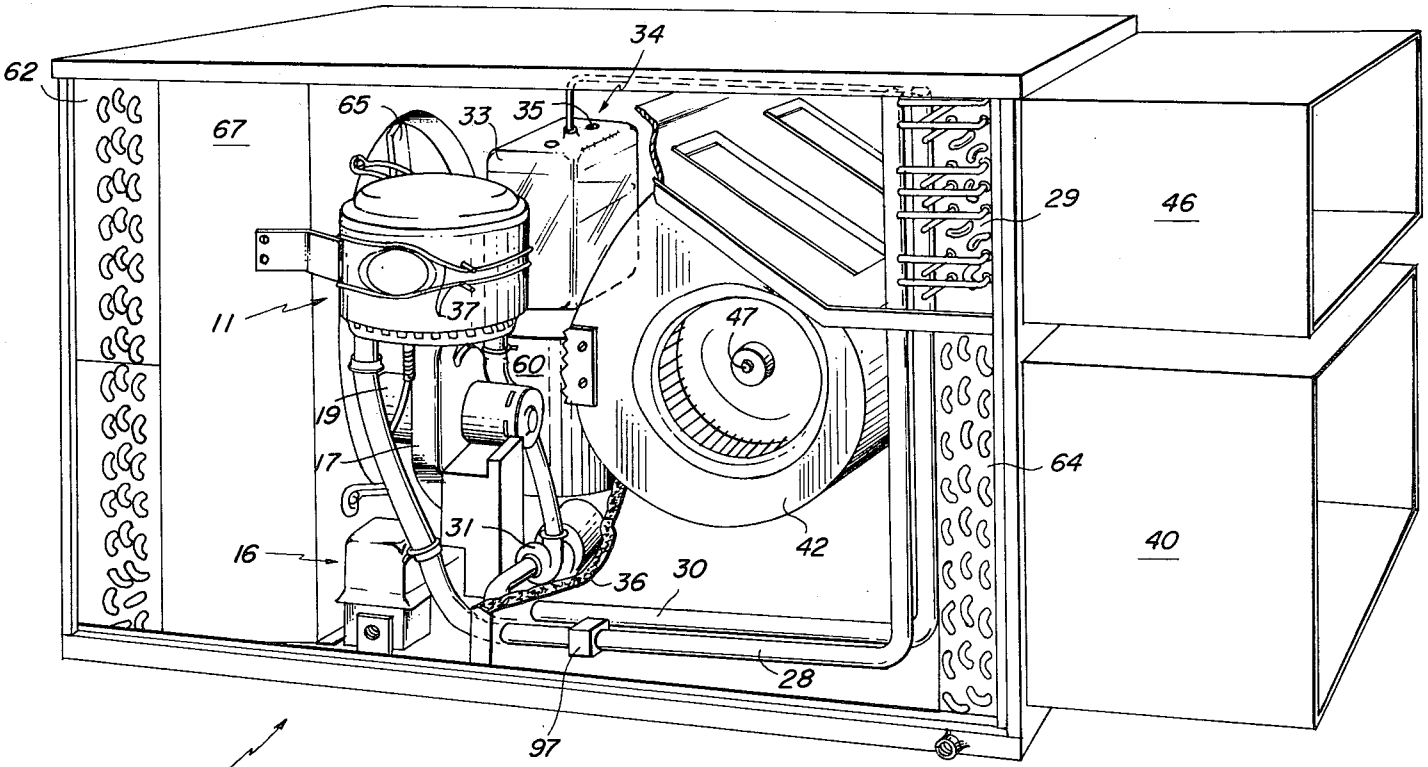
FIG. 1 illustrates a perspective view of a heating and cooling system embodying this invention.
Figure 2:
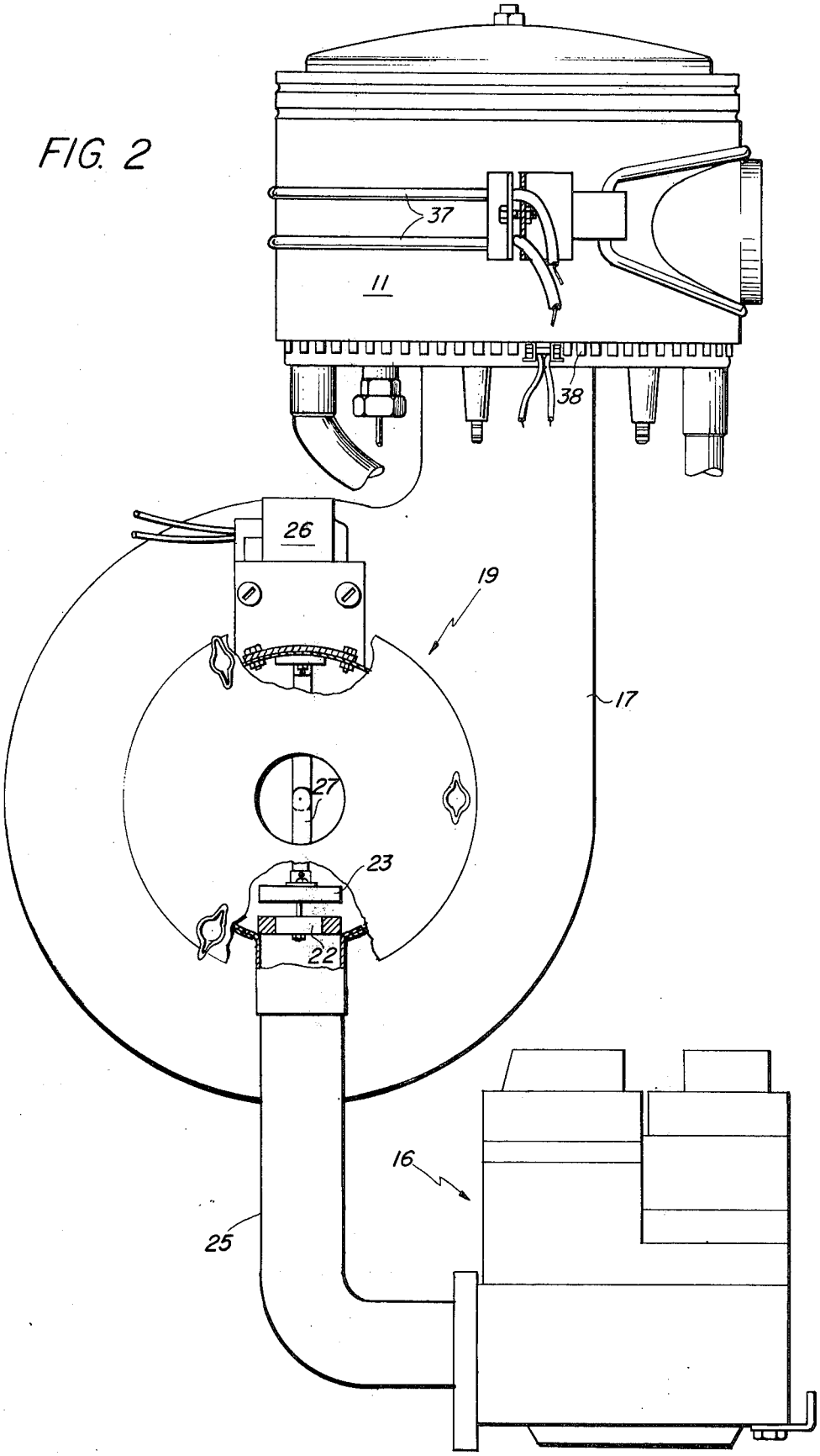
FIG. 2 illustrates a fragmentary side elevation view of the burner heater unit illustrated in FIG. 1.
Figure 7:
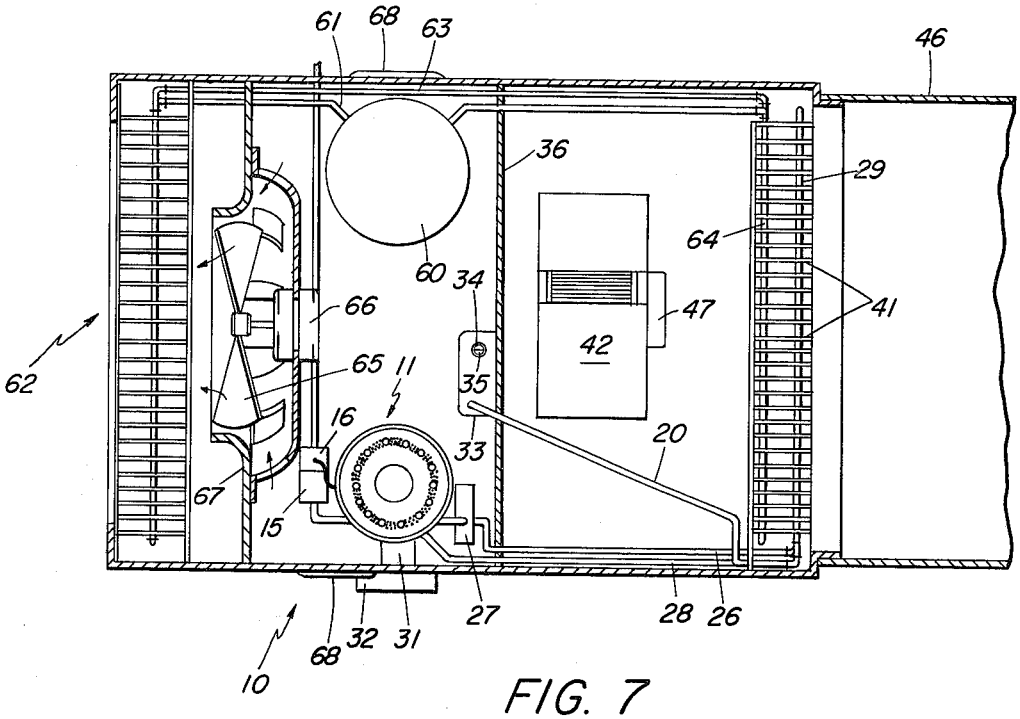
FIG. 7 illustrates a top plan view of a heating and cooling system embodying this invention.
Figure 8:
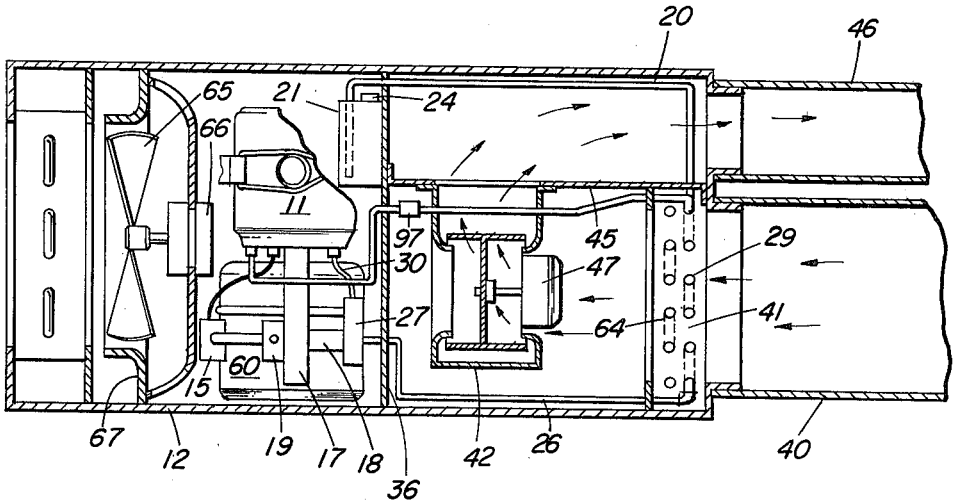
FIG. 8 illustrates a side elevation view of the invention illustrated in FIG. 1.

Referring now to FIGS. 7 and 8, there is shown an alternate embodiment of the invention to that illustrated in FIG. 1 with similar numbers referring to similar portions of the unit. In this version, the blower 42 is positioned in the lower portion of the space separated from the heater region by the wall 36 and blows air drawn from the intake duct 40 through a heat exchanger system in which the heater coils 29 and the evaporator coils 64 are formed with a common set of fins 41 covering the intake duct 40, and the output of the blower 42 is directed through an unobstructed opening into the duct 46 supplying the heated or cooled air to the house. In this version, the input plenum 19 of the burner blower 17 has only a single opening for the air and the fuel and, hence, operates at a single firing rate. However, the multiple firing rate system described in connection with FIG. 1 could be used, if desired. This embodiment has the advantage that combination of the coils 29 and 64 with a common set of fins saves in fabrication costs and by utilizing common fins for both coils somewhat reduces the impedance to the flow of air therethrough compared with using two sets of fins in series. This advantage is partially offset by the fact that the blower 42 works most efficiently if the air is coldest when it passes through the blower, and this condition is optimized by the configuration of FIG. 1.

Figures 9, 10:
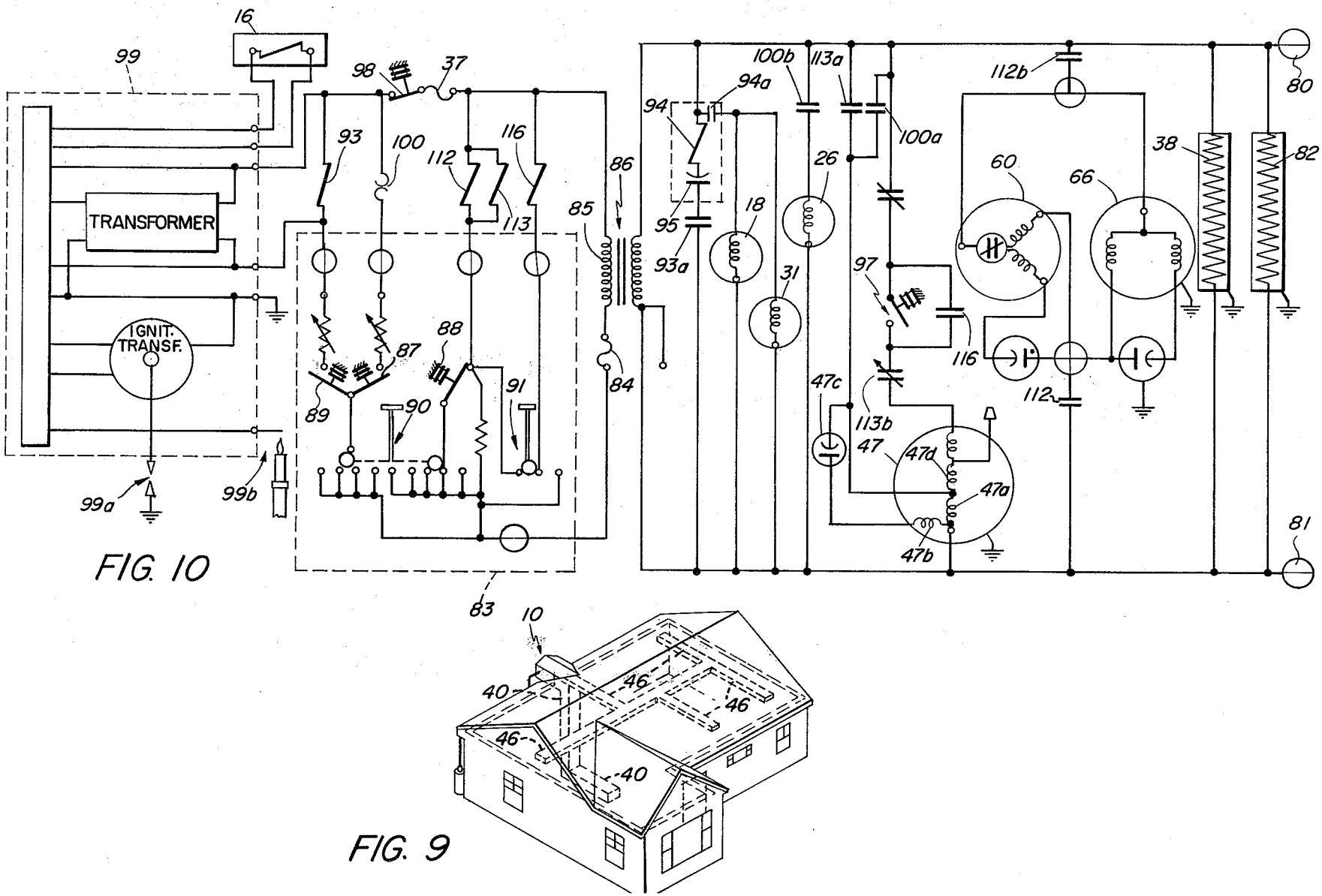
FIG. 9 illustrates an installation of the system of FIGS. 1 through 6 in a home.
FIG. 10 illustrates a schematic diagram of a control circuit for use with the system illustrated in FIGS. 1 through 6.

Referring now to FIG. 9, there is shown a typical installation of a package unit 10 in a home having a gabled roof. The package 10 is on the back of the house and the ducts 40 and 46 are connected through the roof of the house into the attic. As illustrated herein, the duct 46 supplies air to the various rooms of the house through a distribution duct work system blowing the air which has been heated or cooled through the ceiling at the center of each room. The return air is collected by a central duct feeding the duct 40. Gas for the heater 11 may come from a utility supply or from a storage tank at the back of the house from which a pipe is fed to the system 10 on the roof. The package unit 10 may, alternatively, be connected through the wall at the back of the house, may be set in a recess in the wall, may be placed in the basement or in a pit or on a slab at the side or back of the house. In the case of flat roof commercial installations, the unit 10 may be placed on the roof or adjacent an air shaft on the roof.

Referring now to FIG. 10, there is shown a control circuit for the package unit 10 which provides the control functions enumerated in the aforementioned copending application and, in addition, provides for maintaining the burner heat exchanger above the dew point by the heater 38, for multiple burner firing rate control and for a safety fuse surrounding the module.

More specifically, there is shown power line terminals 80 and 81 which may be supplied, for example, through a suitable master control switch (not shown) from a conventional 240-volt 60-cycle AC power source such as a conventional home electric supply which will conventionally be grounded such that terminals 80 and 81 are each maintained at an AC voltage of 120 volts with respect to ground.

A crankcase heater 82, positioned in heat pump compressor 60 and energized at all times from terminals 80 and 81, supplies sufficient heat to the compressor crankcase to maintain the crankcase oil substantially free of condensed refrigerant thereby preventing foaming of the oil upon starting the compressor which would decrease the oil's lubricating ability. Heater 82 may have a small value of, for example, ten to 50 watts.

A module heater 38 is also connected directly to terminals 80 and 81 and may have a value of, for example, 25 to 50 watts for normal operating conditions of the unit. Module heater 38 is clamped around the lower plenum of the gas fired heating unit 11 and maintains the fluid in tubes 13 of the heater at a temperature of, for example, 80° or above at all times. As a result, when the burner starts, no portions of the exhaust flue gas drop substantially below 150° and, hence, substantially no deposits or condensate is produced on the heat exchanger.

While, if desired, the heater 38 may be deenergized during periods when the burner is actually firing, its power drain is very small, costing for example a few pennies per day for electric power. Hence, in the interests of reliability it is maintained continuously connected across the power bus. While it would not normally be economically feasible to maintain heating systems using large hot air heat exchangers and/or combustion volume burners at a temperature above the dew point, the small size and compact volume of the gas fired heating unit used to heat the fluid and the extremely small combustion volume required by the burner result in a unit which can be economically maintained at a temperature above the dew point so that cold burner heat exchanger starts never occur. As a result, little or no condensate or other deposits form on the heat exchanger, and long maintenance-free operation can be produced.

The temperature of the area being heated or cooled, such as the home shown in FIG. 9, is monitored by a thermostat module 83 located at any desired location within the home. Thermostat module 83 comprises three thermostatically operated switches 87, 88 and 89 which, in accordance with well-known practice, are adjusted to the desired operating temperatures depending on the mechanical setting of a bellows or bimetallic strip linkage. As illustrated herein, the thermostat 88 controls the cooling system, and the thermostats 87 and 89 control the heating system.

The thermostat module 83 is a low voltage circuit supplied from terminals 80 and 81 by means of a transformer 86 whose primary winding is connected to terminals 80 and 81 and whose secondary winding 85 supplies a lower AC voltage of, for example, 24 volts to the thermostat module 83.

More specifically, one end of winding 85 is connected through a fuse 84 to a common terminal of a multiple position switch 90 used to select the operating mode of the thermostat as either off, heat, automatic or cool and the common terminal of a second switch 91 used to select operation of the device as either on or automatic.

Switch 90, as shown, is in the heat position and switch 91 is in the automatic position. With switch 90 in the heat position, one side of switches 89 and 87 are connected to the common terminal fed by fuse 84 and the switch 88 is disconnected. Moved one position to the left, switch 90 would disconnect all thermostatic positions while moving one position to the right would connect both the heat switches 87 and 89 and the cooling thermostat switch 88. Moving switch 90 two positions to the right would disconnect heating thermostat switches 87 and 89 while leaving cooling thermostat switch 88 connected. Switch 91 in the position shown provides automatic thermostatic control of the compressor 60 and blower 42 whereas switch 91 moved one position to the right disconnects the compressor and turns on blower 42 to run continuously.

With switch 90 in the position shown and the temperature limits of switches 87 and 89 properly set, for example, for the switch 89 to close when the ambient temperature falls below 68° and the switch 87 to close when the temperature falls below 66°, two firing rates of the unit may be automatically selected. Thus, when switch 89 closes it energizes relay 93 closing relay contacts 93A, in turn energizing a control relay 94 via a condenser 95 closing relay contacts 94A which supplies power to circulating pump 31 and burner blower motor 18. Switch 89 also supplies power to a combustion control module 99 which energizes an ignition gap 99A, shown as the spark plug in FIG. 3, opens solenoid valve 16 and senses the presence of a flame with a flame sensor comprising flame rod 99B, shown in FIG. 3. The ignition flame sensing and control circuitry of control module 99 are conventional, and any desired circuit may be used.

Figure 5:
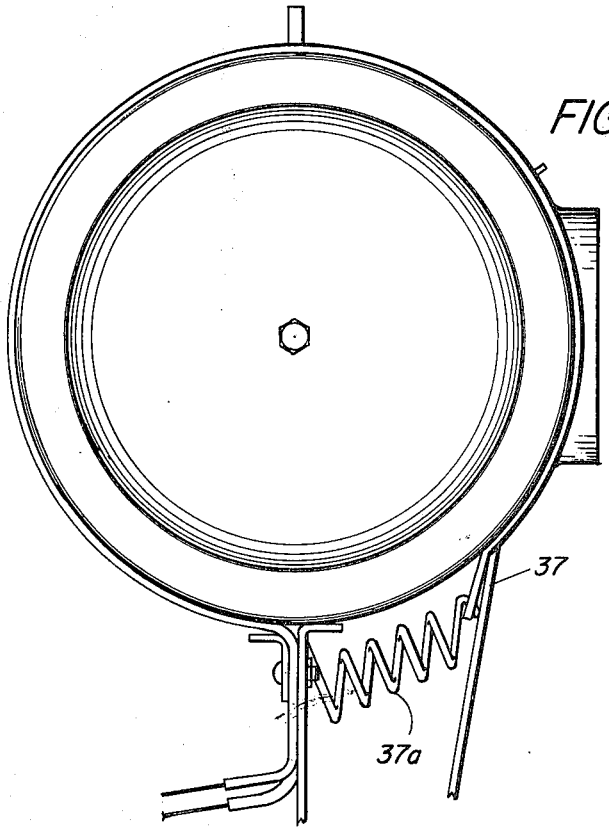
FIG. 5 illustrates a top plan view of the burner heater unit of FIG. 2.

The opposite side of solenoid 93 from switch 89 is returned to transformer winding 85 through a thermostatic water sensing switch 98 illustrated in FIG. 3 and a fuse 37 illustrated in FIGS. 1, 3 and 5 surrounding the exhaust plenum of the heat module 11. In the event of a burnout of the module 11, fuse 37 which consists, for example, of fuse wire in an insulating sheath such as fiberglass cloth, melts and a spring 37A pulls the fuse open thereby shutting down power to relay 93 and fire control module 99 to shut down the heater. When the fluid in the pipe 13 has reached a predetermined temperature, such as 120°F, fluid temperature sensing thermostat 97 closes to energize the low speed winding 47D of blower 47 to circulate air in the heat exchanger 29.

Switch 87, which controls the high firing rate of the burner, energizes a time relay 100 which closes contacts 100A a predetermined time, for example 30 seconds, following closure of thermostatic switch 87. Thus, if the temperature at thermostat module 83 drops rapidly and nearly simultaneously closes switches 87 and 89, the unit will run on low fire for a predetermined time before contacts 100A are closed to run the unit on high fire. Contacts 100A are part of a circuit providing for the control of the blower motor 47 and energizes a high speed winding 47A of motor 47 which also includes a split phase starting winding 47B fed through a phase shifting condenser 47C. Relay 100 also actuates contacts 100B to lift plate 23 and supply the high fire fuel-air mixture to blower 17.

When the burner is shut down, relay contact 94A opens after a predetermined time delay of 60 seconds or so and water temperature control switch 97 remains closed until fluid circulated by the pump 31 cools to a value of, for example, 100°F thereby continuing to run the blower motor 47 until the water is cooled to below 100°F.

If switch 91 is shifted to the on position, relay 116 is energized closing relay contacts 116A in parallel with water temperature switch 97 to retain the blower motor energized in low speed condition continuously. Such operation is sometimes desirable to retain continuous circulation of air through a home. Under these conditions, energization of relay contact 100A simply increases the speed of the blower 47 upon high fire closure thereof. Continuation of operation of the burner blower 18 after fuel shutdown rapidly cools the interior of the burner structure and purges the combustion region of the heater unit of all burnt flue gas while maintaining the circulation of fluid through the tubes 13 prevents a boiling condition which might produce undesirable noises and discharge of excess fluid into overflow tank 33.

If during operation the temperature of the fluid exceeds the temperature limit set for the limit switch 98, switch 98 opens thereby shutting down the burner. The temperatures selected for opening of switch 98 may be, for example, somewhat below the boiling point of the fluid. For example, if the fluid in tubes 13 is water, a temperature of approximately 200°F may be chosen for the opening of the limit switch 98.

When it is desired to operate the package as a cooling system, the switch 90 is preferably placed in the cooling position, and under these conditions when the temperature rises above a predetermined value, the switch 88 closes energizing a compressor relay coil 112 and a fan relay coil 113. In the event that switch 91 is in the automatic position, it also energizes fan relay coil 116. Compressor relay coil 112 closes contacts 112A and 112B energizing compressor motor 60 and fan motor 66. The compressor motor is a conventional capacitor start and run single phase motor having a conventional overload switch associated therewith. When energized, the fan motor 66 cools the condenser coil 62 to cool the compressor refrigerant being pumped thereto by the compressor 60.

This concludes the description of the preferred embodiment of the invention illustrated herein. However, many modifications thereof will be apparent to persons skilled in the art without departing from the spirit and scope of this invention. For example, a compact unit as illustrated herein can use a compact heater circulating fluid to a heat exchanger positioned adjacent the unit which heats hot air for supply to a building to be heated without the installation of a condensing unit for cooling. In addition, heating fluid other than a liquid may be used, such as steam or vapor of other fluids than water. Other means of supplying a cooling system could be used, such as a heat pump system which could use the heat from the heater 11, or a heat pump could be used for heating at moderate temperatures with the gas fired burner used for cold spells. Also, systems may be used in which the circulating pump for the liquid is eliminated and the system can be designed to operate at any desired pressure by selection of the fluid to be circulated through the heater. Furthermore, many modifications of the control circuitry may be made to achieve the control functions set forth in this invention. Accordingly, it is intended that this invention not be limited to the particular details disclosed herein except as defined by the appended claims.

We claim:

1. A heat exchange system comprising:

a heat exchanger comprising a solid structure surrounding a central plenum;

means for supplying the products of combustion to said central plenum of said heat exchanger;

conduit means for directing a fluid to be heated through said heat exchanger; and electrical heater means adjacent to and in heat exchange relationship with said conduit means and means for energizing said heater when said burner is not in operation for maintaining said fluid in said heat exchanger surrounding said central plenum of said heat exchanger above a predetermined temperature during periods when said products of combustion are not being supplied to said heat exchanger.

2. The heat exchange system in accordance with claim 1 wherein the area of the surface in heat exchange relationship with the products of combustion is substantially greater than the area of the surface thereof in heat exchange relationship with said fluid to be heated.

3. The heat exchange system in accordance with claim 2 wherein said heat exchanger comprises a plurality of tubular members positioned in a locus surrounding a central plenum, at least a plurality of said tubular members being interconnected with adjacent tubular members by rigid thermally conductive members.

4. A heat exchange system comprising:

a heat exchanger comprising a solid structure surrounding a central plenum;

means for supplying the products of combustion to said central plenum comprising a burner having an apertured surface and means for supplying a fuel-air mixture through the apertures in said surface at a rate providing a flame front substantially spaced from said surface and extending across regions between jets of said fuel-air mixture issuing from said ports;

conduit means for directing a fluid to be heated through said heat exchanger; and electrical heater means adjacent to and in heat exchange relationship with said conduit means and means for energizing said heater when said burner is not in operation for maintaining said fluid in said heat exchanger and the walls surrounding said central plenum above a predetermined temperature during periods when said products of combustion are not being supplied to said heat exchanger.

5. The heat exchange system in accordance with claim 4 wherein said burner comprises a curved apertured sheet metal structure positioned in a plenum in said heat exchanger.

6. A package heat exchange system comprising:

a fluid heater having a central plenum comprising a plurality of tubular members surrounding said central plenum and rigidly interconnected by a plurality of fins;

a sheet metal burner having a plurality of ports positioned in said plenum and supplied with a gaseous fuel-air mixture through a blower to produce a flame front extending across regions between jets of fuel issuing from said ports and producing combustion of said fuel-air mixture in a region spaced from the sheet metal wall of said burner, said fuel being supplid to the input of said blower through a gas pressure regulator; and means responsive to an electrical control system controlling actuation of said blower for changing the total aperture area in the input of said blower through which said gaseous fuel and said air are supplied to said blower.

7. The package heat exchange system in accordance with claim 6 wherein said means for changing said aperture areas comprises means for enlarging said aperture areas a predetermined time after actuation of said burner.

* * * * *